US007188496B2

(12) United States Patent
Karam et al.

(10) Patent No.: US 7,188,496 B2
(45) Date of Patent: Mar. 13, 2007

(54) METHOD FOR DETECTING THE VIBRATIONS OF A ROLL STAND

(75) Inventors: Michel Abi Karam, Courbevoie (FR); Emilio Lopez Sabio, Valencia (ES)

(73) Assignee: Vai Clecim, Saint-Chamond (FR)

( * ) Notice: Subject to any disclaimer, the term of this patent is extended or adjusted under 35 U.S.C. 154(b) by 0 days.

(21) Appl. No.: 11/256,970

(22) Filed: Oct. 25, 2005
(Under 37 CFR 1.47)

(65) Prior Publication Data

US 2006/0236736 A1 Oct. 26, 2006

(30) Foreign Application Priority Data

Nov. 12, 2004 (FR) ..... 04 12109

(51) Int. Cl.
*B21B 37/00* (2006.01)
*B21B 33/00* (2006.01)

(52) U.S. Cl. ..... 72/13.4; 72/7.2; 72/8.1; 72/10.1; 72/14.1; 72/237; 72/245

(58) Field of Classification Search ..... 72/7.1, 72/7.2, 7.3, 8.1, 9.5, 10.1, 12.1, 13.2, 13.4, 72/13.7, 14.1, 248, 237, 245
See application file for complete search history.

(56) References Cited

U.S. PATENT DOCUMENTS 5,038,591 A * 8/1991 Tajima et al. ..... 72/13.4
5,279,139 A * 1/1994 Sturm ..... 72/13.4
5,724,846 A * 3/1998 Wang et al. ..... 72/237
6,463,775 B1 * 10/2002 Kodama et al. ..... 72/13.4
6,763,694 B1 * 7/2004 Boulton et al. ..... 72/245

FOREIGN PATENT DOCUMENTS

DE 100 23 554 A1 11/2001
EP 1 457 274 A2 9/2004
JP 08247211 A * 9/1996

OTHER PUBLICATIONS

Patent Abstracts of Japan, JP 08141612, Jun. 4, 1996.
Patent Abstracts of Japan, JP 08108205, Apr. 30, 1996.
Patent Abstracts of Japan, JP 60137512, Jul. 22, 1985.

* cited by examiner

*Primary Examiner*—Dmitry Suhol
(74) *Attorney, Agent, or Firm*—Oblon, Spivak, McClelland, Maier & Neustadt, P.C.

(57) ABSTRACT

The invention relates to a method for detecting the vibrations of a roll stand (1) equipped with a hydraulic jack (6) as a device for adjusting the rolling rolls (4, 5). The hydraulic jack comprises a sensor (64) for measuring the position of the mobile portion relative to the fixed portion, this sensor supplying a digital signal (POS). In the method of the invention, the vibrations are detected by direct observation of the position signal (POS) and a comparison thereof relative to a spatio-temporal window (F) whose dimensions are determined as a function of the frequency to be detected. In accordance with the invention, it is possible to define different observation windows (F) suitable for the detection of different vibratory phenomena. In a tandem mill, the position signal (POS) of the hydraulic jack (6) of each roll stand (1) is observed in accordance with the method of the invention, which enables the commencement of vibration on each of the stands to be detected and the stand on which the phenomenon started to be determined.

16 Claims, 2 Drawing Sheets

METHOD FOR DETECTING THE VIBRATIONS OF A ROLL STAND

TECHNICAL FIELD

The present invention relates to a method for detecting the vibrations of a roll stand, both in hot rolling and cold rolling, for various materials. The invention is particularly applicable to the detection of vibrations affecting thickness during the rolling of flat products in the form of strips, in particular using tandem mills.

BACKGROUND OF THE INVENTION

Metallurgical products, in particular flat products, such as sheet metal, strips or ribbons, irrespective of whether they are produced from steel, aluminium or other metals or alloys, are generally manufactured by rolling using mills formed by at least one roll stand and, for example, mills which are formed by a set of stands arranged in series to form what is known as a tandem mill train.

In general, a roll stand comprises large rotating masses, such as working rolls and backing rolls, and reducing gears. These masses may inadvertently start to vibrate, in particular when high-speed rolling is attempted.

This phenomenon, sometimes called "chatter", which is observed more especially in cold tandem trains, resembles a resonance phenomenon because it results in vibration at a substantially fixed frequency for a given roll stand and it occurs beyond a specific speed threshold. It can cause irregularities in the thickness of the strip or breakages of the strip, or marks on the rolls. It is all the more disturbing to production since the most immediate remedy which can be applied to it is to reduce the rolling speed.

Little is known of the origin of these vibrations but it seems to reside in particular in the interactions between the traction of the strips upstream and downstream of a stand and the thickness-reduction process of the stand.

In order better to understand these phenomena, a model was made of the behaviour of roll stands and acceleration meters were placed on them. The simulations and measurements resulting from these tests showed that the most disturbing vibrations had frequencies, on the one hand, in the band from 100 Hz to 250 Hz (third octave) and in the band from 500 Hz to 700 Hz (fifth octave).

Moreover, the effects of those two types of vibration do not seem to be the same since it has been demonstrated that the vibrations of the third octave cause thickness defects and strip breakage while the vibrations of the fifth octave produce marks on the backing rolls. Furthermore, depending on the precise rolling conditions, vibration will not always start at the same frequency but in one of the indicated ranges.

In order to avoid the disadvantages of this chatter phenomenon, it is desirable to be able to detect the occurrence of these vibrations as soon as possible in order to take the necessary corrective measures, for example, reduce the rolling speed.

In order to do that, it has been proposed, for example, in BE 890928, to arrange acceleration meters on the stands, to filter the signal they emit in a suitable frequency band and to trigger a corrective action when the filtered signal exceeds a specific threshold.

Such a method enables the most important damage, such as strip breakage, to be avoided. However, the sensor, of the acceleration meter type, is very sensitive to all acceleration and the signal is generally spoilt by background noise. Thus, an endeavour was made to install it as close as possible to the site where the undesirable vibrations will occur, in general. It was also proposed to install them on the bearings of the rolling-rolls, which makes it necessary to equip all of the sets of bearings and to re-establish the connections at each change of roll.

More recently, it has been possible to install these sensors on the top of the roll stand and to record a workable signal; it is then important to attend to the processing of the signal in order to extract and detect the artefact sought.

However, this processing of the signal, in order to eliminate the background noise, generates a delay which may impair the triggering of the alarm and the corrective action at the desired moment. Furthermore, simple processing in a frequency band does not enable the frequencies of vibrations that have a harmful origin to be distinguished from those that correspond to the normal vibrations caused by some rotating masses of the installation.

In a more recent patent, EP 1 125 649, an attempt was made to remedy these disadvantages by proposing the processing of an acoustic signal coming from a microphone. The problem of the location of the sensor and its fragility is thus solved but the problem of the processing of the signal remains because a microphone detects all of the acoustic frequencies present and the signal is spoilt by major background noise. In order to eliminate the background noise, that patent proposes a processing of the signal, based on a combination of several approaches, the aim of which is to identify the occurrence of detrimental vibrations. In order to do that, it combines bandpass filters, peak detection, resonance factor calculations, Fourier analyses, and triggers an alarm when one of those parameters, or a combination thereof, exceeds a specific threshold in a predetermined frequency band.

That method has disadvantages because the time taken to process the signal is too long and it basically detects the divergence of the start of vibration of a stand of the mill. It has recently been observed that non-divergent vibrations may occur and impair the thickness or the surface state of the rolled product.

In addition, owing to the interaction of the rolling forces of each stand with the upstream and downstream tractions of each of them, the vibration phenomenon generally starts on one stand and spreads to the others. The device proposed can detect only the acoustic frequencies emitted by the stands of the tandem mill as a whole and it is not directly capable of differentiating the stands from one another.

The object of the present invention is to solve those problems by proposing a new detection method operating on the basis of a measurement signal, which method does not have the above-mentioned disadvantages and in particular does not necessitate preliminary processing in order to generate a vibration detection signal.

SUMMARY OF THE INVENTION

In a method according to the invention, the components and sensors that form a modern roll stand are used, namely hydraulic adjusting jacks equipped with digital position sensors of high resolution, in general at least equal to 1 micrometer.

For it has been observed by the inventors that the signal of the position sensor is disturbed by vibration, by an unexpected effect of transmission of that vibration through the entire stack of rolls constituting the roll stand and the hydraulic adjusting jack. Numerous supplementary tests have established that the position signal is completely modulated by the vibration in a manner which is entirely reliable and faithful in terms of frequency and amplitude. Modulation appears as of the start of the occurrence of vibration and the amplitude varies in accordance with that of the vibration, being superimposed on the amplitude variations of the signal which are caused by the action of the system for regulating the thickness.

It is therefore possible to provide a method for detecting the vibrations of a roll stand equipped with a hydraulic adjusting device by observing the measurement signal of the position sensor of the hydraulic adjusting jack; this digital position signal is clear of any background noise, it is normally observed by means of a sampling operation, the period of which is of the order of a millisecond, and it is necessary only to observe directly its amplitude variations over a given interval of time. It is not necessary to have a filter which would cause a delay of several periods relative to that of the vibration to be detected. In a method according to the invention, the measurement signal (POS) of the position sensor is memorized in real time and permanently, a sample of that signal is compared directly with a spatio-temporal observation window (F), of which the dimensions as well as the size of the sample are selected as a function of the roll stand and of the frequency of the vibrations to be detected, and a vibration detection signal is triggered when the signal sample is no longer contained within the window (F).

According to the method of the invention, the temporal dimension of the observation window (F) represents a sufficient length of time for the sample of the position signal contained to be representative of the vibration phenomenon to be detected, if that phenomenon has disturbed the position signal and is therefore also contained in the sample. In a practical manner in the method of the invention, the temporal dimension of the observation window (F) has a length at least equal to a time equivalent to 2 periods of the signal of the vibration phenomenon to be detected.

According to the method of the invention, the height of the observation window (F) has a spatial dimension representing a size greater than the amplitude of the greatest repetitive variation of the position measurement signal (POS) of the hydraulic adjusting jack. In a practical manner according to the method of the invention, the height of the observation window (F) has a spatial dimension representing an amplitude of the position measurement signal (POS) of the hydraulic adjusting jack greater than 4 micrometers.

According to the detection method of the invention, the number of times the amplitude of the position measurement signal (POS) of the hydraulic adjusting jack (6) has exceeded the height of the observation window (F) is counted and a vibration detection is signalled when the number of times the amplitude of the position measurement signal (POS) of the hydraulic adjusting jack has exceeded the height of the observation window (F) is greater than that which is normally observed during corrective actions of the greatest amplitude permitted, of the control systems of the roll stand. In a conventional manner, and in accordance with the method of the invention, a vibration detection is signalled when the number of times the amplitude of the position measurement signal (POS) of the hydraulic adjusting jack has exceeded the height of the observation window (F) is greater than two.

According to a development of the method of the invention, the amplitude of each overshoot relative to the dimension of the window (F) is measured for the observation windows that have triggered a vibration detection signal, and the slope (D) of the variation in the amplitude of each overshoot, in the same observation window (F), is determined for the observation windows that have triggered a vibration detection signal.

According to a variant of the method of the invention, the slope of the variation in the amplitude of each overshoot, in different observation windows (F), is determined for the observation windows that have triggered a vibration detection signal.

Still according to the invention, the method is used for each of the stands of a tandem mill, determining for that purpose a size of the sample of the position measurement signal (POS) of the hydraulic adjusting jack of each stand and a dimensioning of the observation window that are suitable for the frequencies of the vibrations to be detected on each of the stands of the tandem mill.

In the case of the tandem mill, a comparison is made of the slopes (D) of the amplitude variation of the overshoots that have occurred on each stand of the tandem mill.

Then it is decided that the corrective actions to be carried out are performed at least on the stand whose slope (D) of the amplitude variation of the overshoots is the greatest.

According to another variant of the method of the invention, different sizes of the sample of the position measurement signal (POS) of the hydraulic adjusting jack and different dimensionings of the observation window (F) are used to detect different vibration modes of the roll stand, each of them being suitable for the frequencies of the vibrations corresponding to each of the vibration modes to be detected.

BRIEF DESCRIPTION OF THE DRAWINGS

The invention will, however, be better understood by describing a particular embodiment.

DESCRIPTION OF THE INVENTION

Figure 2:
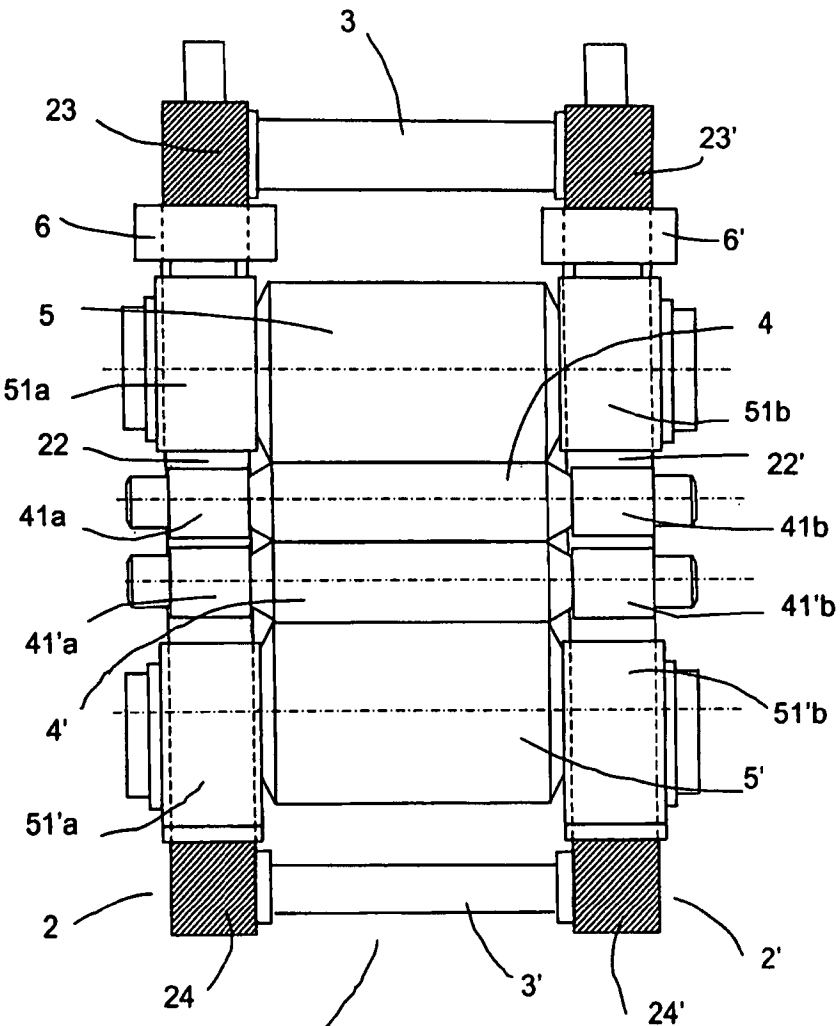
FIG. 2 shows the side view of FIG. 1.
Figure 1:
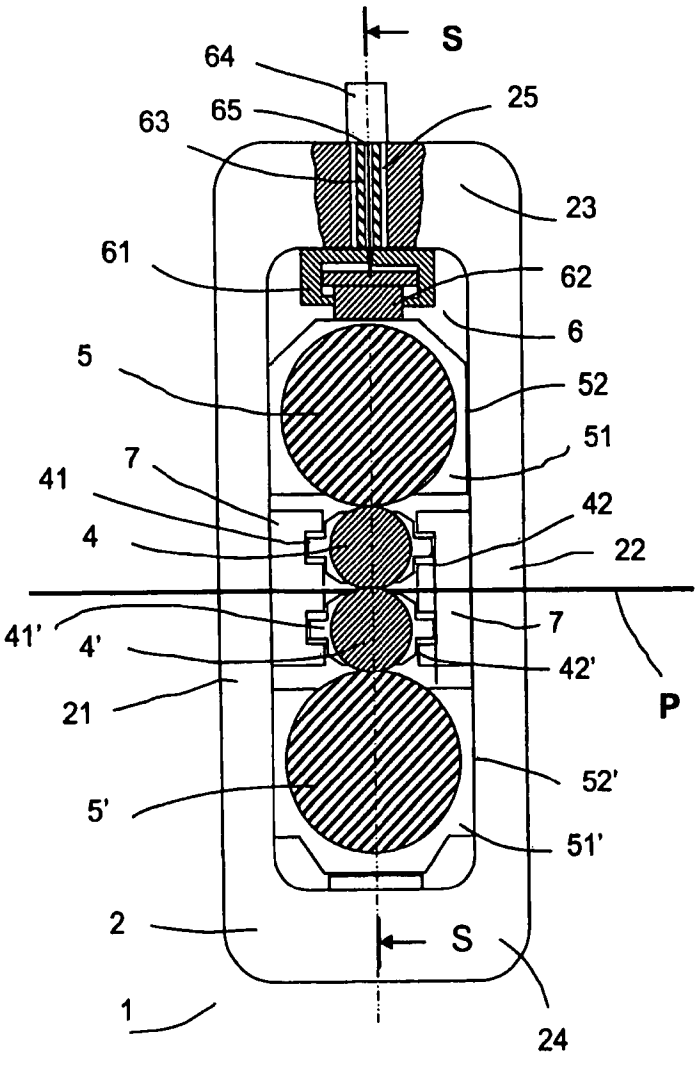
FIG. 1 shows a roll stand which is equipped with a hydraulic adjusting system and which is shown in elevation.

As shown in FIGS. 1 and 2, a roll stand 1 of the four-high type, which is known per se by the person skilled in the art, comprises two support columns 2 and 2', respectively, spaced apart and connected by cross-members 3, 3', between which is mounted a set of superposed rolls having parallel axes placed substantially in the same adjusting plane S perpendicular to the direction of displacement of the product P.

Each column 2, 2' has a shape which is closed to form a ring and each comprises two upright pillars 21, 22 (21', 22', respectively) and two horizontal portions 23, 24 (23', 24', respectively).

The set of superposed rolls comprises two working rolls, 4, 4' between which the product P passes, and two backing rolls 5, 5' on which the working rolls rest.

It should be noted in passing that there are types of roll stand, other than four-high stands, which comprise more rolls, for example six-high stands, or fewer rolls, for example two-high stands. The invention is applicable to all roll stands.

The rolls rest on each other along resting lines which are substantially parallel and which are directed in accordance with a generatrix whose profile, which is normally rectilinear, depends on the forces applied and on the strength of the rolls. Generally, the adjusting force is applied by screws or jacks 6, 6' interposed between the stand and the ends of the shaft of the upper backing roll 5, the lower backing roll 5' resting by way of its ends directly on the roll stand 1. Apart from this last-mentioned roll, the other rolls must therefore be able to move relative to the stand and, to that end, they are carried by support members 51, 51' called chocks; these are mounted to slide vertically in two windows formed between the upright pillars 21, 22 and 21', 22', respectively, of the two columns 2 and 2', respectively, of the roll stand 1.

The rolls are mounted to rotate about their axes in bearings installed in those support members. Thus, the upper backing roll 5 is equipped at its ends with two support members 51*a*, 51*b* sliding vertically between the upright pillars 21, 22 and 21', 22' of the two columns 2 and 2' of the roll stand 1. The lower backing roll 5' is equipped at its ends with two support members 51'*a*, 51'*b* that can slide between the upright pillars 21, 22 and 21', 22' of the two columns 2 and 2' of the roll stand 1 for the purpose of dismounting and changing the backing rolls.

During the rolling stage, the support members 51'*a*, 51'*b* of the lower backing roll 5' rest directly on the lower horizontal portions 24, 24' of the columns 2, 2' of the roll stand 1.

The invention relates to roll stands whose adjusting means are constituted by hydraulic jacks. In the embodiment described and corresponding to FIGS. 1 and 2, those hydraulic jacks are installed at the upper portion of the stand. However, configurations exist in which the jacks are installed at the lower portion of the roll stand. It is in this latter case that the upper backing roll rests directly by way of its support members 51*a*, 51*b* on the upper horizontal portions 23, 23' of the columns 2, 2' of the roll stand 1.

The invention can be applied equally well to either of the configurations without departing from the scope of the protection afforded by the claims.

Adjusting means constituted by hydraulic jacks resting on the lower surface of the upper horizontal portion 23, 23' of the columns 2 and 2' of the roll stand 1 exert a vertical force in the closing direction of the rolls for the rolling of the product P passing between the working rolls 4, 4'.

Generally, each working roll is mounted to rotate about its axis on bearings carried by two support members called chocks 41*a*, 41*b* and 41'*a*, 41'*b* and these are mounted to slide parallel with the adjusting plane S passing by way of the axes of the working rolls, each between two flat guide faces formed one on each side of the adjusting plane on the two sides of the corresponding window of the stand. As the backing rolls have a large diameter, the corresponding guide faces 52, 52' are generally formed directly on the two pillars of the corresponding column of the stand.

On the other hand, since the working rolls have a smaller diameter, their chocks are smaller and the corresponding guide faces 42, 42', which are closer together, are generally formed on two solid pieces 7 which are fixed to the two pillars framing the window and which extend in a projecting manner towards the inside of the window. Those blocks may comprise devices for controlling the deflection of the working rolls, generally jacks, which are not shown in the Figure. No further description is required of any of those well-known roll stand devices which have been the subject of numerous publications and patents.

Thus, a squeezing force adjustable by the hydraulic pressure of the jack can be applied to the product to be rolled P by way of the stack of rotating rolls which thus permit the passage of the product P. Each hydraulic jack is constituted by a jack body 61 and a piston 62 between which oil is injected. The hydraulic pressure comes from a power plant equipped with pumps and the oil is generally injected into the jack by way of servo-valves. These devices are not shown. They are well known in the field of mill equipment and rolling and they have been the subject of numerous patents and publications.

In order to control the squeezing action on the product, the hydraulic jack is equipped with a position sensor. In the embodiment shown in FIG. 1, the body of the jack 61 constitutes the fixed portion of the adjusting device and rests on the lower surface of the horizontal portion 23 of the column 2 of the roll stand 1. The piston 62 constitutes the mobile portion of the adjusting device which exerts the force on the upper portion of the chocks 51*a*, 51*b* of the upper backing roll 5. The movement of the piston is transmitted by a rod 65 to the sensor 64 installed above the column. Often a single position sensor located on the axis of the hydraulic adjusting jack is provided. To that end, a hole 25 is drilled in the upper horizontal portion 23 of the column 2. Sealing with respect to the body of the jack 61 and with respect to the rod 65 connected to the piston 62 is provided by a sealing device 63. No further description is required of that type of mounting which has been the subject of patents belonging to the Applicant. It will be appreciated that the same device is installed in the other column 2' of the roll stand and, in the embodiment described, this device exerts the adjusting force between the horizontal portion 23' of the column 2' and the chock 51*b* of the upper backing roll 5.

In addition, position sensors, such as digital optical rulers, which supply a digital position signal with an accuracy to within at least one micrometer, have been known for many years. There also exist other types of position sensor based on other technologies capable of supplying a signal of the same type. It should finally be noted that it is possible, for reasons of space or jack technology, to carry out the installation in the opposite manner, that is to say, to install the body of the jack on the top of the chocks 51*a*, 51*b* of the backing roll 5, the piston 62 then resting on the horizontal portion 23, 23' of the columns 2 and 2' of the roll stand 1.

During rolling under the effect of the force transmitted to the product P, the various portions of the roll stand are deformed resiliently; the pillars 21, 21' and 22, 22' become longer, and the working rolls 4, 4' and the backing rolls 5, 5' are crushed as are also, to a lesser extent, the chocks of the backing rolls. Those deformations as a whole are referred to as the yielding of the roll stand and the value thereof is proportional to the adjusting force. It is thus that the value of the displacement of the piston relative to the body of the jack must be greater than the variation produced at the air gap existing between the working rolls between which the product is rolled. However, it is known how to establish the equations governing all of that and it is known how to establish roll stand models and yielding models for determining the air gap variations as a function of the variations in the position of the adjusting jacks and in the rolling force. It is thus possible to control the air gap of the rolling operation by that of the position of the hydraulic jacks.

In addition, the various elements of the stand may start to vibrate. The vibrations are transmitted especially to the adjusting jacks and the position sensors of those jacks, enabling the vibrations to be recorded.

Figure 3:
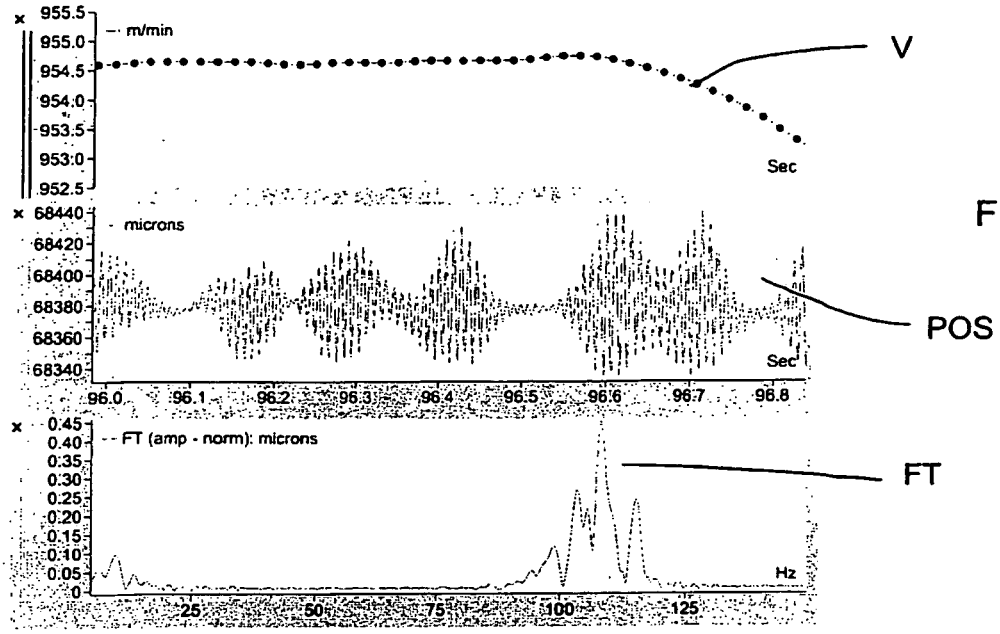
FIG. 3 shows a typical recording of the measurement signal of the position sensor disturbed by vibration.

FIG. 3 shows what it is possible to observe in accordance with the method of the invention. The recording in the central portion POS shows the signal of the sensor for measuring the position of the hydraulic adjusting jack. By a surprising effect, the position signal retransmits the commencement of chatter vibration of the entire mill in an entirely clear and faithful manner. It is observed here in the form of beating which becomes increasingly amplified.

For, as stated, all of the stands of a tandem mill are capable of vibrating, and on slightly different frequencies, which may explain the beating phenomenon. On this mill, which has been the subject of experiments and investigations carried out by the inventors and which is still not equipped with an automatic system, the operator has brought about a deceleration visible on the curve V. The effect is immediately visible on the signal of the position sensor. Detection was slow, when the signal reached a sufficient amplitude, because this operation was carried out by the operator in manual mode.

Approximately 10 periods of the signal can be counted on this recording over a time interval of 100 milliseconds, which corresponds to a frequency close to 100 Hz. The curve FT is the Fourier transform of the position signal POS. Examination thereof has proved that the vibration phenomenon was clearly identified by observing the position signal POS because the Fourier transform, calculated over a time interval enabling a sample representative of the observed signal to be obtained, shows a peak at a frequency of approximately 110 Hz and two lesser lateral peaks located approximately at 105 Hz and 115 Hz; they represent the secondary vibration frequencies which cause the beating.

This recording shows that the signals coming from the position sensors are clearly representative of the vibrations which it is desired to detect.

Therefore, there is no need for additional sensors, like those of the generally fragile acceleration meter type, the installation of which is tricky and the signal of which is often accompanied by major background noise, nor for sophisticated signal processing in order to select the significant signal from among all of the signals supplied, and requiring numerous transformations which generate substantial delays, in order to be able to detect the commencement of a state of vibration in a roll stand.

In the method of the invention, the position signal POS coming from the digital sensor with which the hydraulic jacks of the adjusting device of the roll stand are equipped, is observed directly for a suitably chosen time interval, and the shape of the signal and the development of its amplitude over time is thus monitored to trigger a vibration detection signal. This can be done, according to the method of the invention, by direct observation of the position signal POS.

The signal of the position measurement sensor is supplied in digital form and its sampling frequency is of course sufficiently high to observe a signal whose frequency is approximately from 100 Hz to 200 Hz, while at the same time complying with signal processing laws, such as Shannon's law. In practice, the position sensor is read every millisecond or every two milliseconds. This signal is the reflection of the control carried out by the thickness-regulating system. It is possible to see the appearance there of specific periodic signals resulting from defects in the circular form or eccentricity of the rolls, but the highest frequency contained in those signals would then be of the order of from 20 Hz to 30 Hz for a rolling rate ranging from 1500 to 2000 meters per minute. In addition, the amplitude of the variation in the position of the mobile portion of the hydraulic jack is generally a few micrometers and may reach some tens of micrometers in normal operation and in steady state.

In a complete control system of a tandem mill, the roll stands are pre-set to clearly determined values as a function of the product to be rolled and the reduction in thickness to be obtained; the settings are then deliberately limited in their amplitude of action in order to detect any operating or pre-setting anomalies when those settings arrive, for example, at the limit of action. It is therefore entirely possible to know on the basis of which values of their amplitude the variations in the position signal are the reflection of other phenomena. In the example of FIG. 3, the chatter phenomenon immediately brings about variations in amplitude exceeding 10 micrometers over a time interval of some tens of milliseconds.

In the method of the invention, the position signal is therefore memorized by means of a given number of points and it is observed, or it is compared with the size of a spatio-temporal window. When the signal is no longer contained in that window, a vibration detection alarm is triggered. The width of the window, along the time axis, has a dimension corresponding to a significant time interval relative to the period of the signal to be detected. In practice, it is possible to take, for example, a time greater than or equal to two cycles of the signal. As stated above, the height of the window, along the space axis, has a dimension corresponding to a size greater than those of the repetitive corrections given by the setting systems; in practice it is possible to fix a threshold, for example, at 4 micrometers. It remains to determine the frequency of the overshoots of the signal outside the observation window. In order to do that, the number of overshoots outside the window is counted and compared with the maximum number for which those overshoots are observed for the strongest actions of the setting systems, for example, those corresponding to the pre-set limits. In a practical manner, if it is desired to detect a vibration frequency of the order of 100 Hz and the position signal has been memorized over a time interval equivalent to two periods of the signal to be detected, that is to say, approximately 20 milliseconds, this frequency will definitely be present if there are more than two overshoots outside the window with an amplitude greater than the fixed threshold.

Measurement is then started again with the memorizing of the position signal over another time interval in order to create another observation window. Depending on the case, and in order to take into account the particular features of some installations, it is possible to use different methods of memorizing and storing the measurements, such as, for example, the instantaneous freezing of a given number of measurement points (latch), the filling and emptying of a FIFO (first IN first OUT) queue or the creation of a sliding average by adding a new point to each new measurement and by removing the first point taken into account. All of those methods create a succession of measurement point samples of the position signal of the hydraulic jack of the adjusting device which can be compared in succession with the defined observation window.

Figure 4:
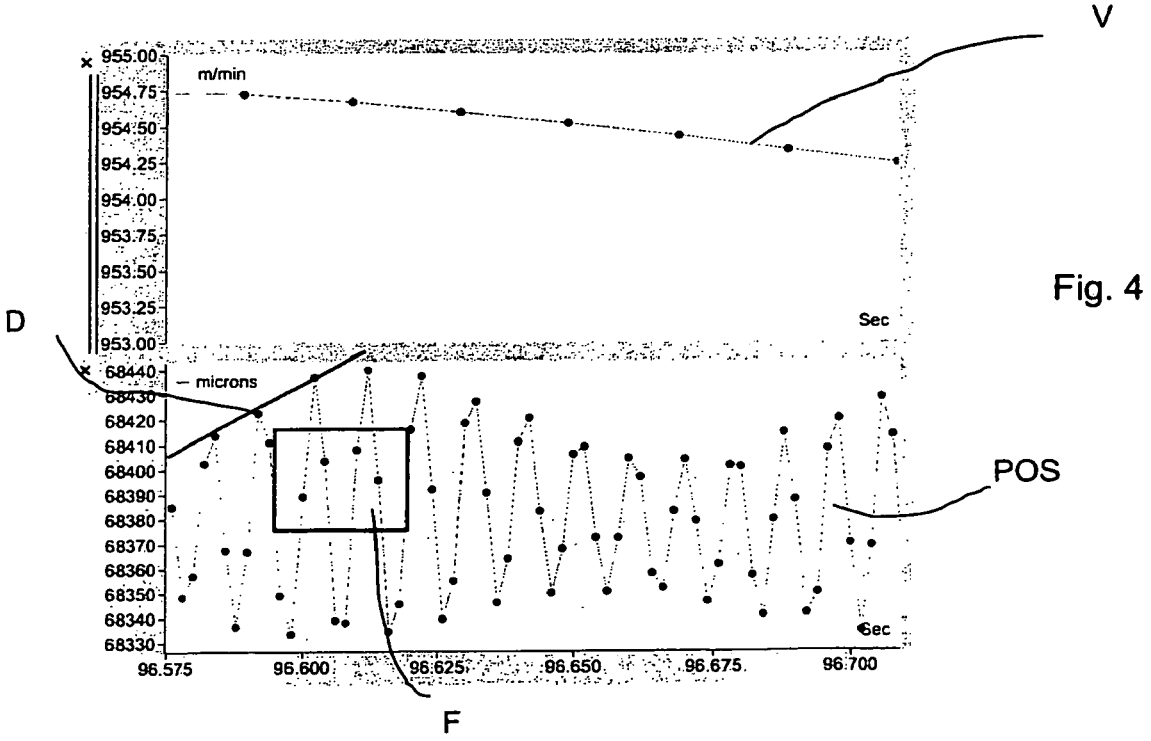
FIG. 4 illustrates the method of the invention.

FIG. 4 thus illustrates the observation method of the method of the invention. It represents a view extended along the horizontal axis of the signal shown in FIG. 3 for a period of time during which the position signal is disturbed by the chatter vibration phenomenon. An observation window F is shown in FIG. 4 and corresponds to the minimum values of the thresholds which have been defined above. These thresholds have to be adjusted in accordance with the characteristics of the installation and the tendency to enter into harmful vibratory states because it is not desirable to bring about frequent decelerations of the installation, but, on the other hand, it is advantageous to detect vibrations as soon as possible because they affect the thickness or the surface state of the rolled product P before becoming divergent and causing more substantial damage.

It should also be noted that the method of the invention makes it possible, on the basis of the observation of the position signal, to detect a vibratory state, or a variation in the vibratory state, of a roll stand, corresponding to different phenomena. The defects in the circular form and the eccentricity of the rolling rolls have already been mentioned but it is possible to detect other defects resulting, for example, from wear on the members of the drive systems, such as the reducing gears or the torque transmission power trains. In order to do that, it is necessary only to characterise the frequency and amplitude defect and to define an observation window according to the method of the invention. It is then possible to observe the memorized samples of the position signal through the various windows thus defined and corresponding to different defects to be detected.

In a tandem mill, it is possible to establish observation windows that differ in accordance with each stand and that are adapted to the particular characteristics thereof. For example, if some stands are of the four-high type and others are of the six-high type, they will have different characteristics, and in all cases the diameter ranges of the rolls used on each stand are different, as are also the characteristics of the drive. For the same motors are generally used on all of the stands and, bearing in mind the various speeds of the product in the successive stands, the reduction ratios of the speed reducers used are different. The fastest and most efficient means of action when the chatter phenomenon appears is to slow the installation down. However, if it is desired to prevent the phenomenon from being reproduced during the subsequent acceleration, it is desirable to change other parameters, otherwise it is necessary to operate the installation at a slower speed and productivity losses are substantial. It is therefore particularly important to determine on which stand the phenomenon first appeared in order to modify its operating conditions, for example, by changing the lubrication or the temperature of the lubricant or any other parameter known for its influence on the conditions for setting a roll stand in vibration.

Thus, in a development of the method of the invention, the amplitude of the overshoot of the position signal in each observation window is calculated. This can be done on a predetermined stand using different observation windows selected as a function of different vibratory phenomena to be monitored. This can also be done on the whole of the tandem mill on the basis of the observation windows of the same type, which are set at the specific values of each stand. It is thus possible to evaluate the amplitude of the phenomenon in accordance with the stands. However, in order to determine with certainty which stand of the tandem mill started to vibrate first, the single criterion of the amplitude may be doubtful in particular cases because, as illustrated by FIG. 3, the chatter phenomenon may have a form modulated by beating, the amplitude of which varies. That may complicate the location of the point where the phenomenon starts.

In another development of the method of the invention, after calculating the amplitude of the overshoots, the variation in those overshoots inside each observation window is determined and the gradient of those variations when the phenomenon starts on each of the stands of the tandem mill is calculated. This is illustrated in FIG. 4 by the slope of the straight line D which connects the peaks of the curve representing the oscillations of the position signal. The stand on which the problem appeared first is that for which the greatest slope is measured for the straight line D. For it is on that stand that the signal has been amplified the fastest and it is therefore that stand which was subjected to the original exciting phenomenon and which induced the vibrations of the other stands and then there may have been resonance and beating phenomena between the stands of the tandem mill.

In the method of the invention, it is thus possible to detect as soon as possible a vibration phenomenon which may affect the thickness or the surface state of the rolled product P and also to detect a divergent phenomenon and give an alarm that can trigger corrective actions. After bringing about a deceleration of the tandem mill and avoiding major damage, the indication, thanks to the method of the invention, of the stand on which the phenomenon started enables its operating conditions to be modified in order to prevent the recurrence of the problem during the subsequent re-acceleration.

However, the invention is not limited to the single embodiment described. Thus, it is possible to produce the hydraulic adjusting device of the mill in different manners and to supply it with various possible fluids, and likewise it is possible to equip the mobile portion and/or the fixed portion of the adjusting device with different types of digital sensor giving the position of one of those two portions relative to the other while remaining within the scope of the invention. As stated, the vibration phenomena were observed most often on cold tandem mills for rolling steel strips, but the method of the invention can be applied to hot mills and to single-stand mills as well as to those used for the production of strips made of non-ferrous materials, such as, for example, aluminium. Moreover, it has been stated that the method of the invention can be used to detect different vibration modes of the roll stands, and it is also possible to use it to detect any anomaly bringing about rapid variations in the position signal, of the repetitive or non-repetitive pulsed type, without departing from the scope of the invention. For example, a roll mark will cause a defect which will generate a brief pulse at each rotation of the roll and, in order to detect it in accordance with the method of the invention, it is necessary only to determine the appropriate dimensions of the observation window. Thus, in order to simplify drafting, the term "vibration" has been used in the claims but it must be extended to any anomaly causing a repetitive or non-repetitive signal of rapid variation without departing from the scope of the invention.

Likewise, the reference signs inserted after the technical features mentioned in the claims are aimed solely at facilitating understanding of the claims and they do not limit the scope thereof in any way.

The invention claimed is:

1. A method for detecting the vibrations of a roll stand of the type comprising two pillars which each form a ring and between which are located a set of rolling rolls, formed by at least two working rolls, which enable the thickness of the product to be rolled to be reduced and which are stacked in a substantially vertical plane constituting the adjusting plane and are mounted to rotate in chocks forming bearings, which chocks are mounted to slide vertically between guide surfaces supported by the upright portions of the pillars, the roll stand comprising means for adjusting the rolls by means of hydraulic jacks resting on a horizontal portion of each pillar and exerting the adjusting force on the chocks of the rolls, the hydraulic jacks also comprising a position sensor which gives at each instant a signal representative of the position of the mobile portion of the hydraulic jack, and of the chock, relative to the fixed portion of the hydraulic jack, and to the horizontal portion of each pillar, wherein the measurement signal of the position sensor is memorized in real time and permanently, in that a sample of that signal is compared directly with a spatio-temporal observation window, the size of the sample and the dimensions of the window being chosen as a function of the roll stand and the frequency of the vibrations to be detected, and in that a vibration detection signal is triggered when the signal sample is no longer contained within the window.

2. A method for detecting the vibrations of a roll stand according to claim 1, wherein the temporal dimension of the observation window has a length of time sufficient for the sample contained to be representative of the vibration phenomenon to be detected.

3. A method for detecting the vibrations of a roll stand according to claim 2, wherein the temporal dimension of the observation window has a length at least equal to a time equivalent to 2 periods of the signal of the vibration phenomenon to be detected.

4. A method for detecting the vibrations of a roll stand according to claim 2, wherein the height of the observation window has a spatial dimension representing a size greater than the amplitude of the greatest repetitive variation of the position measurement signal of the hydraulic adjusting jack.

5. A method for detecting the vibrations of a roll stand according to claim 3, wherein the height of the observation window has a spatial dimension representing a size greater than the amplitude of the greatest repetitive variation of the position measurement signal of the hydraulic adjusting jack.

6. A method for detecting the vibrations of a roll stand according to claim 5, wherein the height of the observation window has a spatial dimension representing an amplitude of the position measurement signal of the hydraulic adjusting jack greater than 4 micrometers.

7. A method for detecting the vibrations of a roll stand according to claim 1, wherein the number of times the amplitude of the position measurement signal of the hydraulic adjusting jack has exceeded the height of the observation window is counted.

8. A method for detecting the vibrations of a roll stand according to claim 7, wherein a vibration detection is signalled when the number of times the amplitude of the position measurement signal of the hydraulic adjusting jack has exceeded the height of the observation window is greater than that normally observed during corrective actions of the greatest amplitude permitted, of the control systems of the roll stand.

9. A method for detecting the vibrations of a roll stand according to claim 7, wherein a vibration detection is signalled when the number of times the amplitude of the position measurement signal of the hydraulic adjusting jack has exceeded the height of the observation window is greater than two.

10. A method for detecting the vibrations of a roll stand according to claim 7, wherein the amplitude of each overshoot relative to the dimension of the window is measured for the observation windows that have triggered a vibration detection signal.

11. A method for detecting the vibrations of a roll stand according to claim 10, wherein the slope of the variation in the amplitude of each overshoot, in the same observation window, is determined for the observation windows that have triggered a vibration detection signal.

12. A method for detecting the vibrations of a roll stand according to claim 10, wherein the slope of the variation in the amplitude of each overshoot, in different observation windows, is determined for the observation windows that have triggered a vibration detection signal.

13. A method for detecting different vibration modes of a roll stand according to the method of claim 1, wherein different sample sizes of the position measurement signal of the hydraulic adjusting jack and different dimensionings of the observation window are used, each of them being adapted to the frequencies of the vibrations corresponding to each of the vibration modes to be detected.

14. A method for detecting the vibrations of the stands of a tandem-mill comprising a plurality of stands, using the method of claim 1, wherein, for each roll stand, a sample size of the position measurement signal of the hydraulic adjusting jack and a dimensioning of the observation window which are adapted to the frequencies of the vibrations to be detected on the roll stand are used.

15. A method for detecting the vibrations of the stands of a tandem mill comprising a plurality of stands using the method according to claim 14, wherein the slopes of the variation in the amplitude of the overshoots are determined for each stand of the tandem mill.

16. A method for detecting and correcting the vibrations of the stands of a tandem mill according to claim 15, wherein the corrective actions to be carried out are performed at least on the stand whose slope of the variation in the amplitude of the overshoots is the greatest.

* * * * *